US011358258B2

(12) United States Patent
Chiang

(10) Patent No.: US 11,358,258 B2
(45) Date of Patent: Jun. 14, 2022

(54) RATCHET WRENCH

(71) Applicant: William Tools Co., Ltd., Taichung (TW)

(72) Inventor: Shui-Lai Chiang, Taichung (TW)

(73) Assignee: WILLIAM TOOLS CO., LTD., Taichung (TW)

( * ) Notice: Subject to any disclaimer, the term of this patent is extended or adjusted under 35 U.S.C. 154(b) by 35 days.

(21) Appl. No.: 16/923,568

(22) Filed: Jul. 8, 2020

(65) Prior Publication Data

US 2021/0060740 A1 Mar. 4, 2021

(30) Foreign Application Priority Data

Aug. 29, 2019 (TW) ..... 108131109

(51) Int. Cl.
*B25B 13/46* (2006.01)
*B25B 23/00* (2006.01)

(52) U.S. Cl.
CPC ..... *B25B 13/463* (2013.01); *B25B 23/0035* (2013.01)

(58) Field of Classification Search
None
See application file for complete search history.

(56) References Cited

U.S. PATENT DOCUMENTS 1,078,059 A * 11/1913 Mossberg ..... B25B 13/463 81/63
1,382,492 A * 6/1921 Evans ..... B25B 13/463 81/63
1,426,265 A * 8/1922 Elenchuk ..... B25F 1/003 81/57.5
3,958,470 A * 5/1976 Lee ..... B25B 13/463 81/63
4,308,769 A * 1/1982 Rantanen ..... B25B 13/463 81/63
4,336,728 A * 6/1982 Deibert ..... B25B 13/463 192/43.1
5,000,066 A * 3/1991 Gentiluomo ..... B25B 13/463 81/62

FOREIGN PATENT DOCUMENTS

| | | | |
|---|---|---|---|
| CN | 106392967 | A | 2/2017 |
| CN | 208068129 | U | 11/2018 |
| CN | 208304886 | U | 1/2019 |
| CN | 208977685 | U | 6/2019 |
| TW | I632028 | B | 8/2018 |
| TW | M566644 | U | 9/2018 |
| TW | M572287 | U | 1/2019 |
| TW | I652147 | B | 3/2019 |
| TW | M576088 | U | 4/2019 |
| TW | I661909 | B | 6/2019 |

* cited by examiner

*Primary Examiner* — Hadi Shakeri
(74) *Attorney, Agent, or Firm* — Muncy, Geissler, Olds & Lowe, PC

(57) ABSTRACT

A ratchet wrench is provided, including a main body, a ratchet mechanism and a switch mechanism. The ratchet mechanism includes a ratchet and a pawl unit. The switch mechanism includes a pushing member and a moving member, the pushing member is disposed on the moving member, the pushing member is optionally connected to the pawl unit, and the moving member is movably disposed on the main body.

8 Claims, 11 Drawing Sheets

RATCHET WRENCH

BACKGROUND OF THE INVENTION

Field of the Invention

The present invention relates to a ratchet wrench.

Description of the Prior Art

A traditional box wrench can be used to tighten or loosen a screw or a bolt, but it requires a greater space for this type of box wrench to rotate. If the space is limited, a user can only rotate the box wrench for an angle, so the user needs to sleeve the box wrench onto and off repeatedly. This is troublesome. Therefore, the industry developed a ratchet wrench which includes a ratchet mechanism into a wrench main body, so the user can swing the ratchet wrench back and forth in a small angle to tighten or loosen the bolt, and s/he does not need to take the ratchet wrench down and sleeve it onto the bolt repeatedly. This type of ratchet wrenches are disclosed in TWI661909, TWI652147, TWI632028, TWM572287, TWM576088 and TWM566644 or CN208977685, CN106392967, CN208304886 and CN208068129.

However, the structure of the above-mentioned ratchet wrench has already been a set pattern for the industry, and few people keep studying and improving the structure of the ratchet wrench, so there are no innovative and unique structures on the market recently, and problems like complex structure, processing difficulty and low assembling efficiency still exist.

The present invention has arisen to mitigate and/or obviate the afore-described disadvantages.

SUMMARY OF THE INVENTION

The major object of the present invention is to provide a ratchet wrench which improves a switch mechanism to let a user switch a rotation direction of a ratchet just by pushing, so it is convenient and quick for the user to operate. In addition, when a head portion enters a narrow space, the user still can switch the direction of the ratchet from outside.

To achieve the above and other objects, a ratchet wrench is provided, including a main body, a ratchet mechanism and a switch mechanism. The ratchet mechanism includes a ratchet and a pawl unit, the ratchet is rotatably received within the main body, the pawl unit is received within the main body and swingable relative to the ratchet, the pawl unit includes a toothed portion, a first recess and a second recess, the toothed portion faces the ratchet, and an opening of the first recess and an opening of the second recess are opposite to the ratchet. The switch mechanism includes a pushing member and a moving member, the pushing member is disposed on the moving member and closer to the pawl unit, and the moving member is disposed on the main body and movable toward the ratchet to drive the pushing member to insert into the first recess or the second recess. When the pushing member is inserted into the first recess, the pushing member pushes the pawl unit and swings toward a first direction to make a first end of the toothed portion meshed with the ratchet; when the pushing member is inserted into the second recess, the pushing member pushes the pawl unit and swings toward a second direction to make a second end of the toothed portion meshed with the ratchet, and the second direction is opposite to the first direction.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
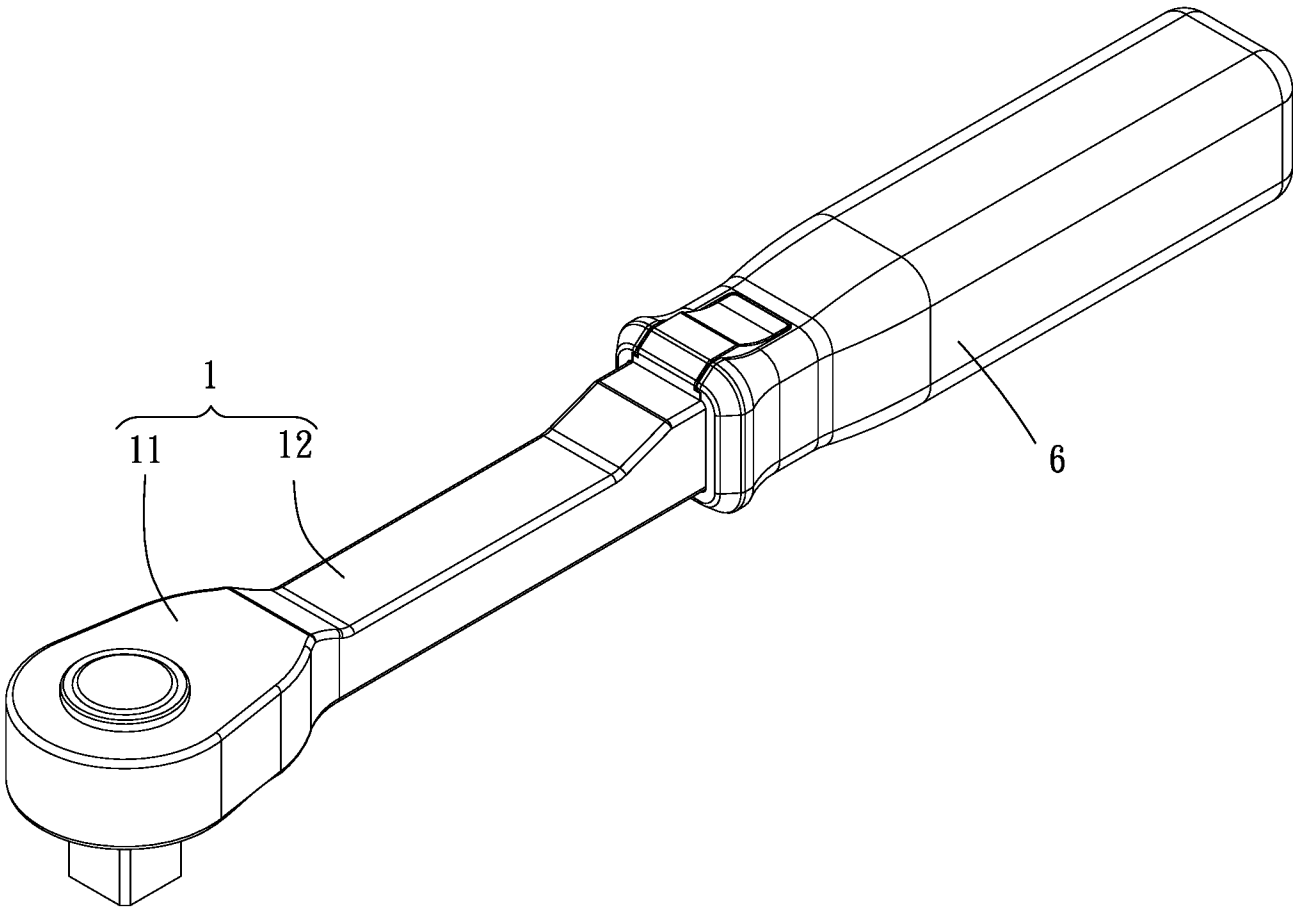
FIG. 1 is a stereogram of a first embodiment of the present invention.
Figure 2:
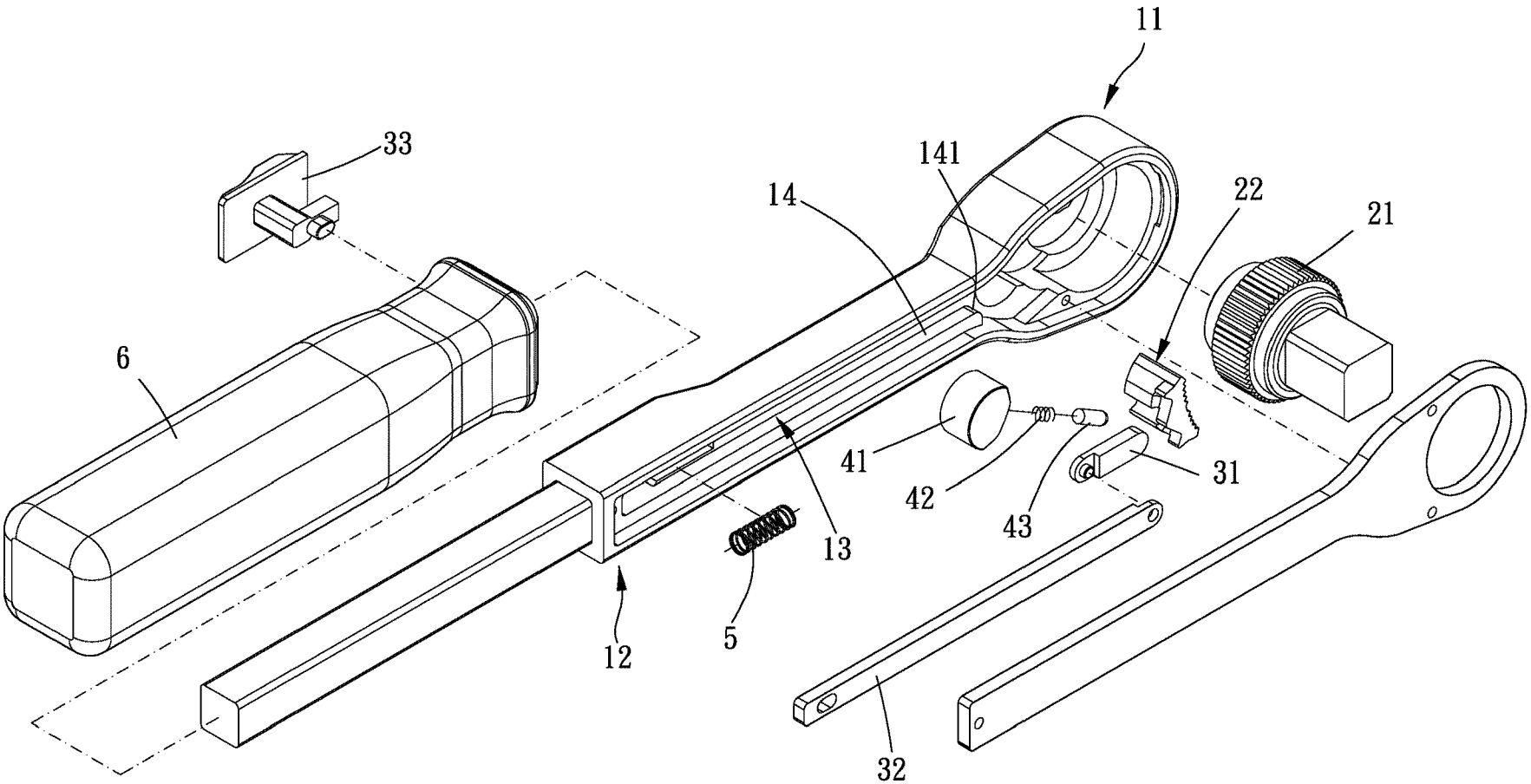
FIG. 2 is a breakdown view of FIG. 1.
Figure 3:
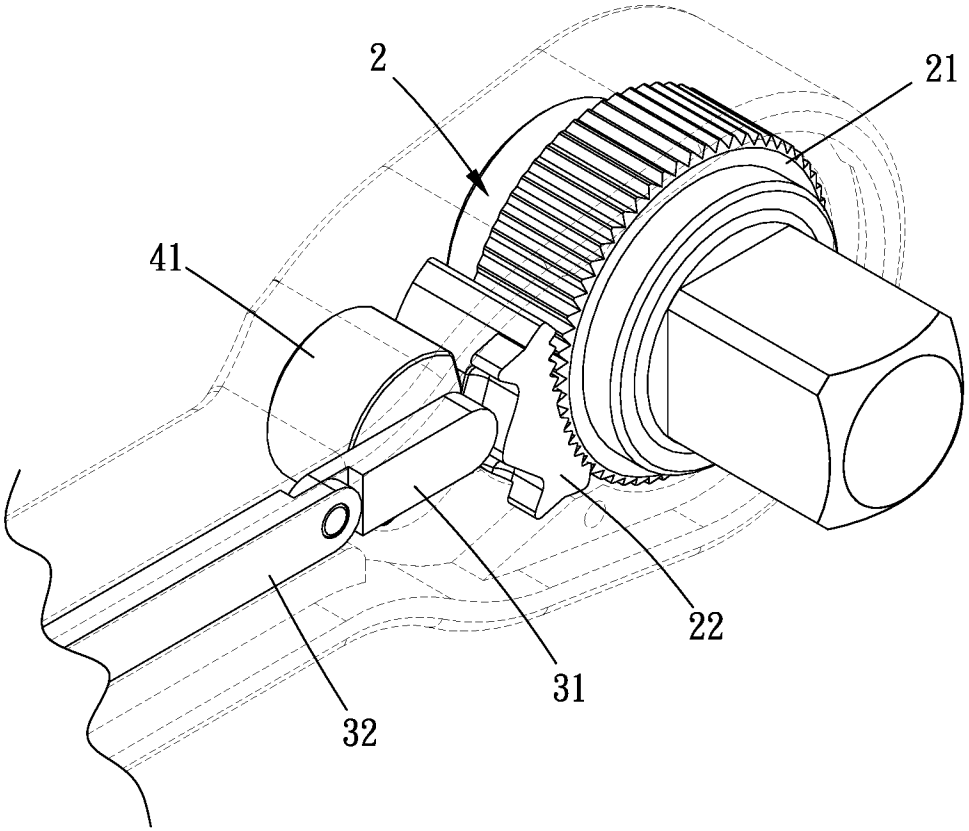
FIG. 3 is a partial stereogram of the first embodiment of the present invention.
Figure 5:
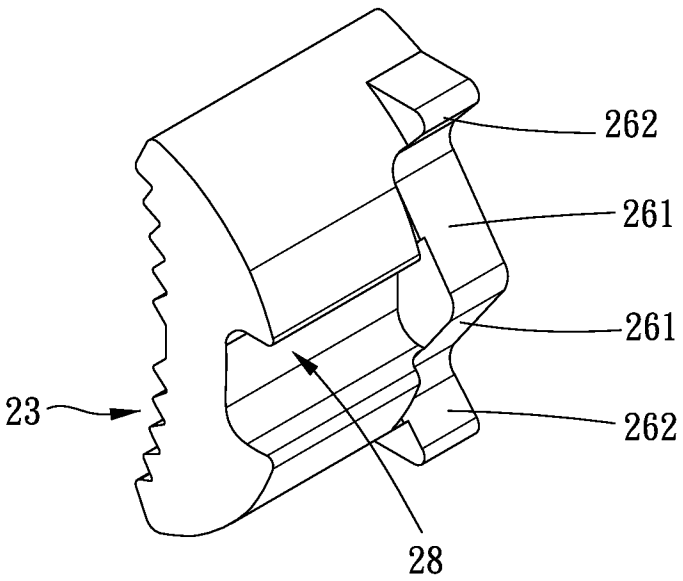
FIGS. 4 and 5 are enlarged stereograms of a pawl unit of the first embodiment of the present invention.
Figure 4:
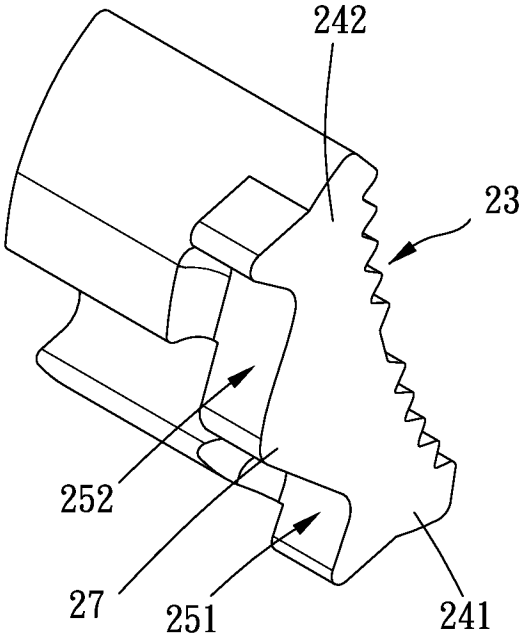
Figure 6:
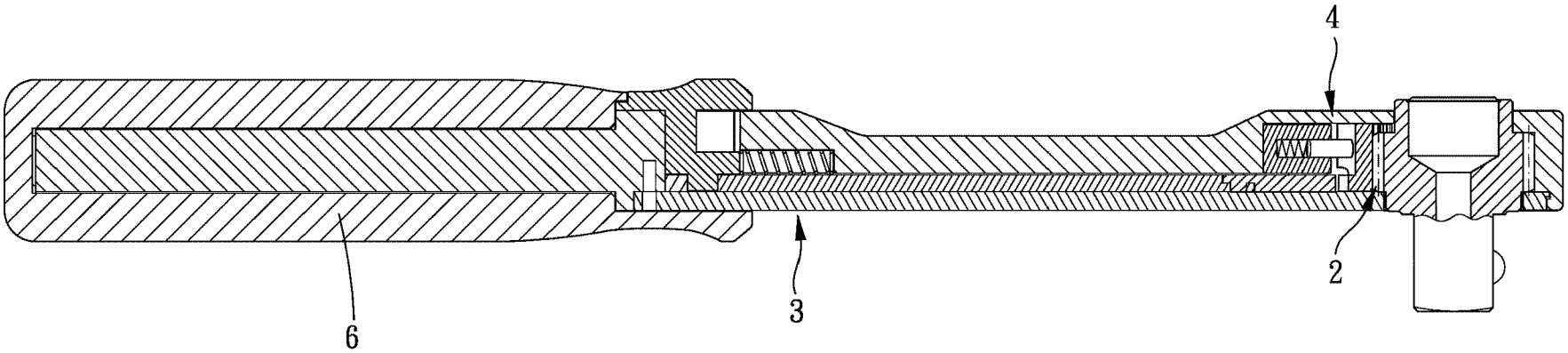
FIGS. 6 and 7 are cross-sectional side views of the first embodiment of the present invention.
Figure 7:
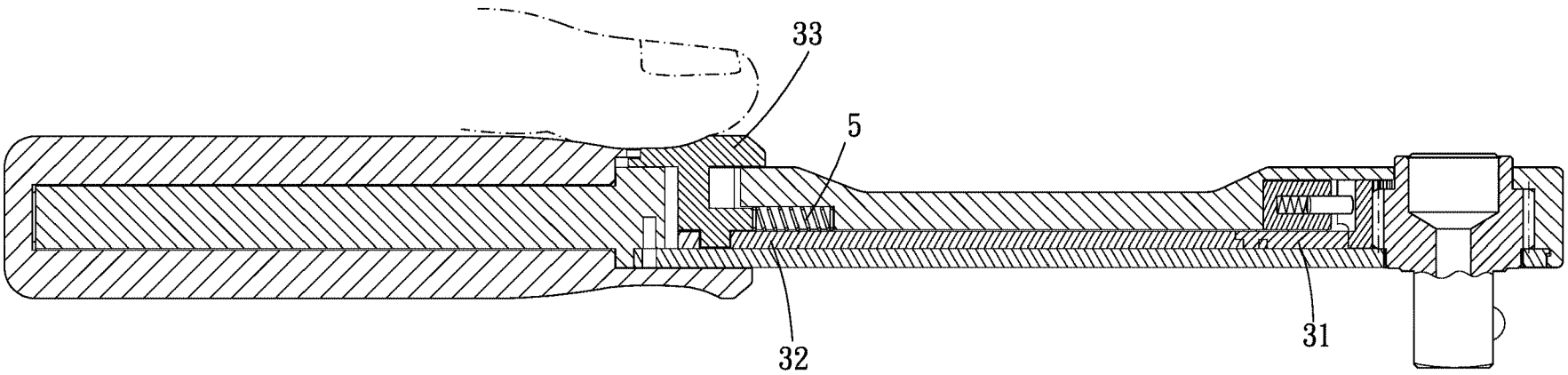
Figure 8:
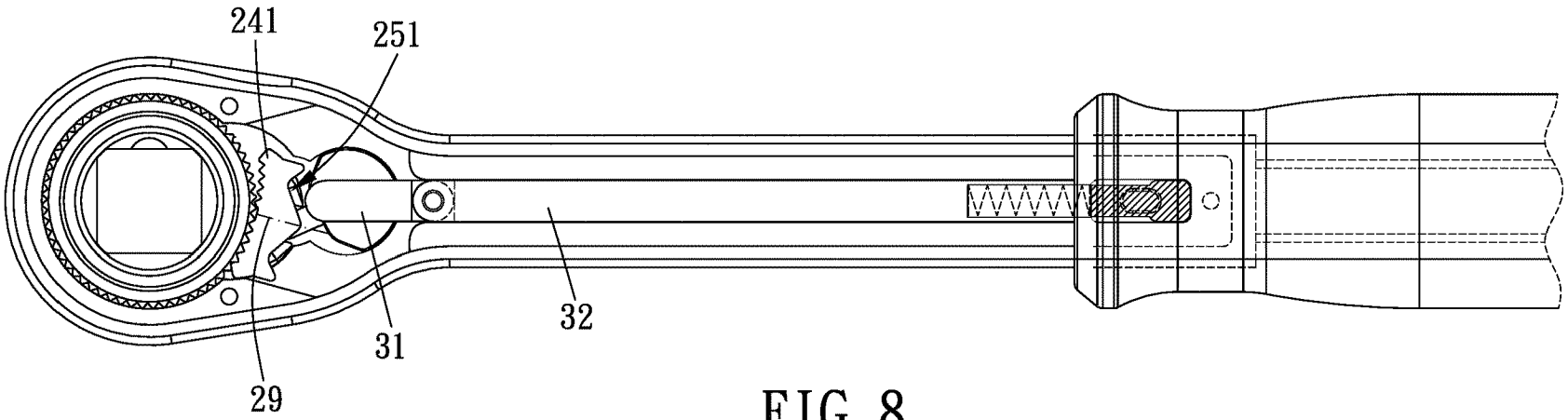
FIGS. 8 to 11 are drawings showing a switch mechanism of the first embodiment of the present invention in operation.
Figure 9:
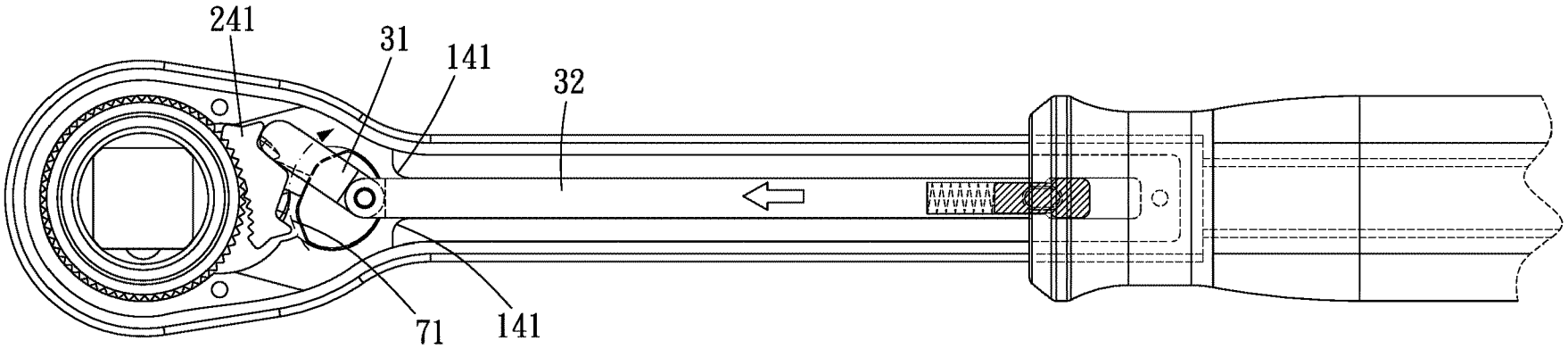
Figure 10:
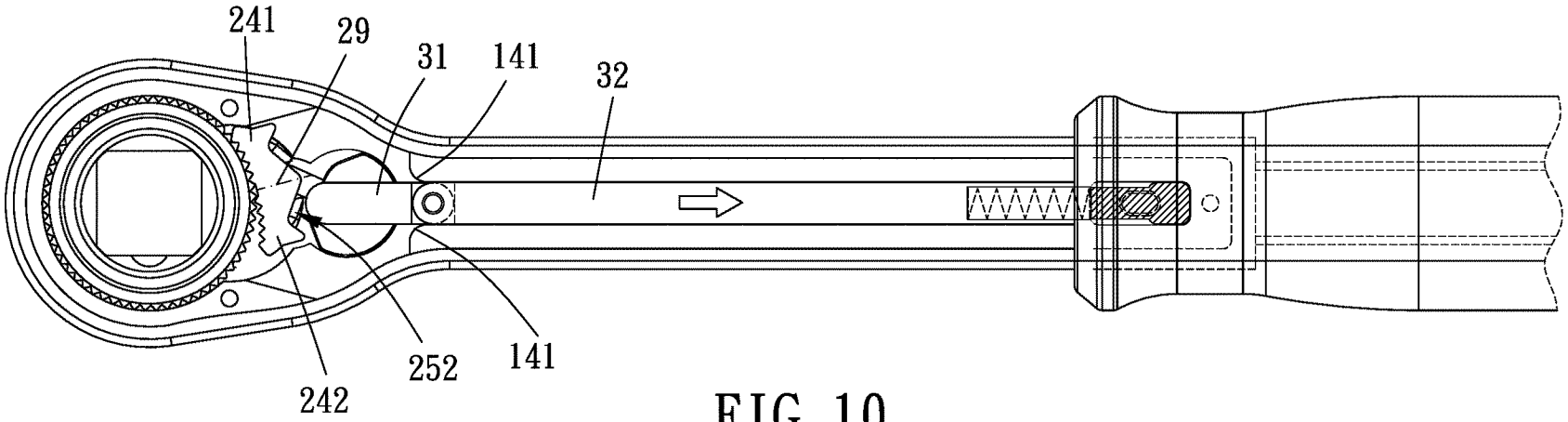
Figure 11:
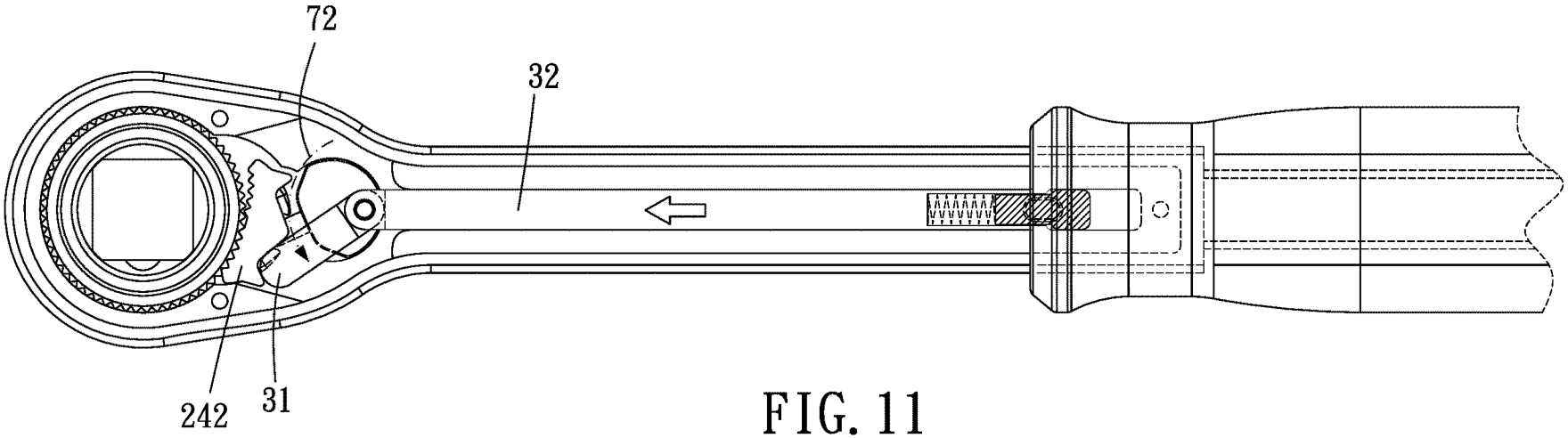
Figure 12:
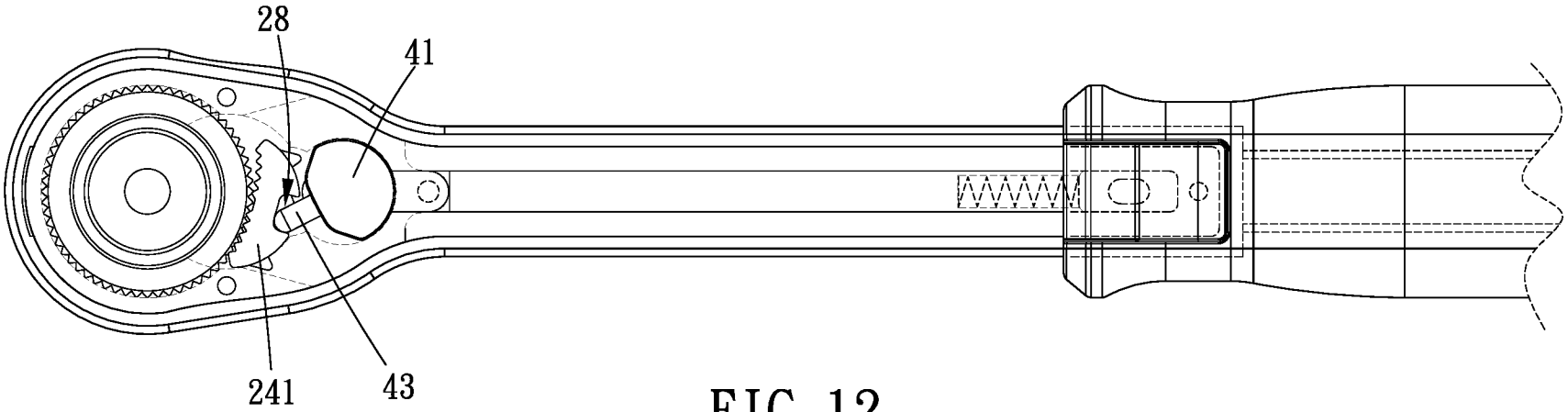
FIG. 12 is a view of FIG. 10 from another perspective.
Figure 13:
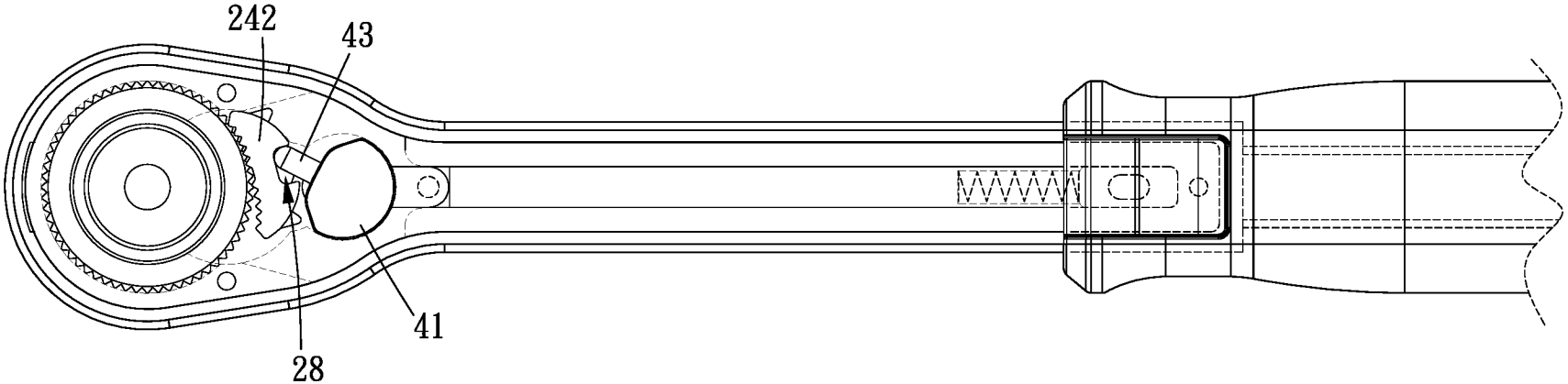
FIG. 13 is a view of FIG. 8 from another perspective.

The present invention will be clearer from the following description when viewed together with the accompanying drawings, which show, for purpose of illustrations only, the preferred embodiment in accordance with the present invention.

Please refer to FIGS. 1 to 13 for a first embodiment. A ratchet wrench includes a main body 1, a ratchet mechanism 2 and a switch mechanism 3.

The ratchet mechanism 2 includes a ratchet 21 and a pawl unit 22, the ratchet 21 is rotatably received within the main body 1, the pawl unit 22 is received within the main body 1 and swingable relative to the ratchet 21, the pawl unit 22 includes a toothed portion 23, a first recess 251 and a second recess 252, the toothed portion 23 faces the ratchet 21, and an opening of the first recess 251 and an opening of the second recess 252 are opposite to the ratchet 21. The switch mechanism 3 includes a pushing member 31 and a moving member 32, the pushing member 31 is disposed on the moving member 32 and closer to the pawl unit 22, and the moving member 32 is disposed on the main body 1 and movable toward the ratchet 21 to drive the pushing member 31 to insert into the first recess 251 or the second recess 252.

When the pushing member 31 is inserted into the first recess 251, the pushing member 31 pushes the pawl unit 22 and swings toward a first direction 71 to make a first end 241 of the toothed portion 23 meshed with the ratchet 21; when the pushing member 31 is inserted into the second recess 252, the pushing member 31 pushes the pawl unit 22 and swings toward a second direction 72 to make a second end 242 of the toothed portion 23 meshed with the ratchet 21, and the second direction 72 is opposite to the first direction 71.

Specifically, when the first end 241 of the toothed portion 23 is meshed with the ratchet 21, the second recess 252 is on an extension direction of the moving member 32, the moving member 32 is controlled to move toward the ratchet 21, the pushing member 31 is inserted into the second recess 252 to push the pawl unit 22 to swing and make the second end 242 of the toothed portion 23 meshed with the ratchet 21, and the first recess 251 is now on the extension direction of the moving member 32. When a user controls the moving member 32 to move toward the ratchet 21 again, the pushing member 31 is inserted into the first recess 251, and the first end 241 of the toothed portion 23 is meshed with the ratchet 21. In other words, to switch a rotation direction of the ratchet 21, the user only needs to push the moving member 32 to move toward the ratchet 21.

Preferably, the switch mechanism 3 further includes a control member 33, the control member 33 is positioned on an end of the moving member 32 remote from the ratchet 21 and projects beyond the main body 1, and the control member 33 and the moving member 32 are in a co-movement relationship, so the user can drive the moving member 32 to move by pushing the control member 33. In this embodiment, an area of a cross-section of the control member 33 is twice an area of a cross-section of the moving member 32 or more to ensure a contact area of the control member 33 and a hand of the user can be as large as possible.

More preferably, the ratchet wrench further includes a rebound member 5, one of two ends of the rebound member 5 is arranged on the main body 1, the other of the two ends of the rebound member 5 is arranged on the switch mechanism 3, and the moving member 32 (the switch mechanism 3) has a tendency to move away from the ratchet 21 normally. That is, the switch mechanism 3 automatically returns to an initial position, and the user can switch a rotation direction of the ratchet 21 only by pushing the control member 33 forward.

Still more preferably, the ratchet wrench further includes a grip 6, and a part of the main body 1 is inserted into the grip 6, so the grip 6 is comfortable for the user to hold.

The pawl unit 22 has an insertion hole 28, the insertion hole 28 and the first and second recesses 251, 252 are on two opposite end portions of a side of the pawl unit 22 facing the moving member 32, the ratchet wrench further includes a support mechanism 4, the support mechanism 4 includes a pivot member 41, an elastic member 42 and an abut member 43, the pivot member 41 is swingably positioned on the main body 1, the elastic member 42 is received within the pivot member 41, one of two ends of the abut member 43 abuts against the elastic member 42, the other of the two ends of the abut member 43 is inserted into the insertion hole 28, and the pivot member 41 and the pawl unit 22 are in a co-rotation relationship. When the ratchet 21 rotates in a first rotation direction, the support mechanism 4 is used to provide a support force to a first end 241 of the toothed portion 23 or the second end 242 of the toothed portion 23 so as to keep the first end 241 or the second end 242 meshed with the ratchet 21 normally; when the ratchet 21 rotates in a second direction opposite to the first rotation direction, the abut member 43 retracts into the pivot member 41, the toothed portion 23 and the ratchet 21 slip from each other, and the ratchet 21 idles.

Specifically, two halves of the pawl unit 22 have symmetrical structures with respect to a center line 29 of the pawl unit 22, the first and second recesses 251, 252 are spacingly arranged by two opposite sides of the center line 29, the first and second recesses 251, 252 have a protrusion 27 therebetween, the insertion hole 28 corresponds to the protrusion 27 on a direction perpendicular to the center line 29, and the center line 29 separates the protrusion 27 and the insertion hole 28 evenly. In addition, as viewed in a direction which is perpendicular to the moving direction of the moving member 32, the insertion hole 28 is C-shaped, a contour of the protrusion 27 is upside-down V-shaped, and a contour of a circumferential wall of the first recess 251, a circumferential wall of the second recess 252 and the protrusion 27 is W-shaped.

More specifically, the circumferential wall of the first recess 251 includes a tilted wall 261 and a block wall 262 which are laterally connected to each other, the tilted wall 261 extends toward a direction which is close to the ratchet 21 but away from the center line 29, when the pushing member 31 is inserted into the first recess 251, the pushing member 31 swings along the tilted wall 261 to abut against the block wall 262 to be in a co-swinging relationship, a circumferential wall structure of the second recess 252 is the same as a circumferential wall structure of the first recess 251, and the circumferential wall structure of the second recess 252 and the circumferential wall structure of the first recess 251 are symmetrically arranged with the center line 29 as the symmetry axis.

Preferably, on a direction lateral to the moving direction of the moving member 32, the pushing member 31 and the pivot member 41 are stacked, so the pushing member 31 can slide on a surface of the pivot member 41 to elevate the stability of the pushing member 31 in a moving or swinging process.

In this embodiment, the pushing member 31 is swingably pivoted to the moving member 32, the main body 1 includes a head portion 11 and a handle portion 12 which communicate with each other, the ratchet mechanism 2 is received within the head portion 11, the moving member 32 is received within the handle portion 12, and at least one part of the pushing member 31 projects into the head portion 11. In addition, the moving member 32 and the pushing member 31 are each elongated to prevent the moving member 32 and the pushing member 31 from rotating relative to each other unexpectedly. A ratio of a length of the moving member 32 and a length of the pushing member 31 is preferably greater than 3 so that the control member 33 can be disposed on a place where is farther from the head portion 11 and closer to a part for the user to grip on. Moreover, when the head portion 11 enters a narrow space, the user can switch the rotation direction via the control member 3 which is outside the space, so the user does not have to pull the head portion 11 out of the space repeatedly during the operation process.

The handle portion 12 has a passage 13, the passage 13 communicates with an interior of the head portion 11, and the moving member 32 is movably disposed through the passage 13. When the moving member 32 moves away from the ratchet 21, a pivoting point of the pushing member 31 and the moving member 32 enters the passage 13, and at least one wall 14 which defines the passage 13 is used to guide and restrict the pushing member 31 to be in line with the moving member 32; when the moving member 32 moves toward the ratchet 21, the pivoting point of the pushing member 31 and the moving member 32 moves out of the passage 13, and the pushing member 31 is swingable relative to the moving member 32 freely.

Preferably, a side of the at least one wall 14 which is close to the pawl unit 22 has a chamfered portion 141 which is curved, and when the moving member 32 moves away from the ratchet 21, the pushing member 31 which is tilted is pushed by the chamfered portion 141 to gradually swing to be in line with the moving member 32. In the first embodiment, the passage 13 is defined by two walls 14, the two walls 14 are spacingly arranged by two opposite sides of the grip 12, and the two walls 14 are each elongated.

To be noted, the pushing member 31 and the moving member 32 can be connected to each other in other ways.

Figure 14:
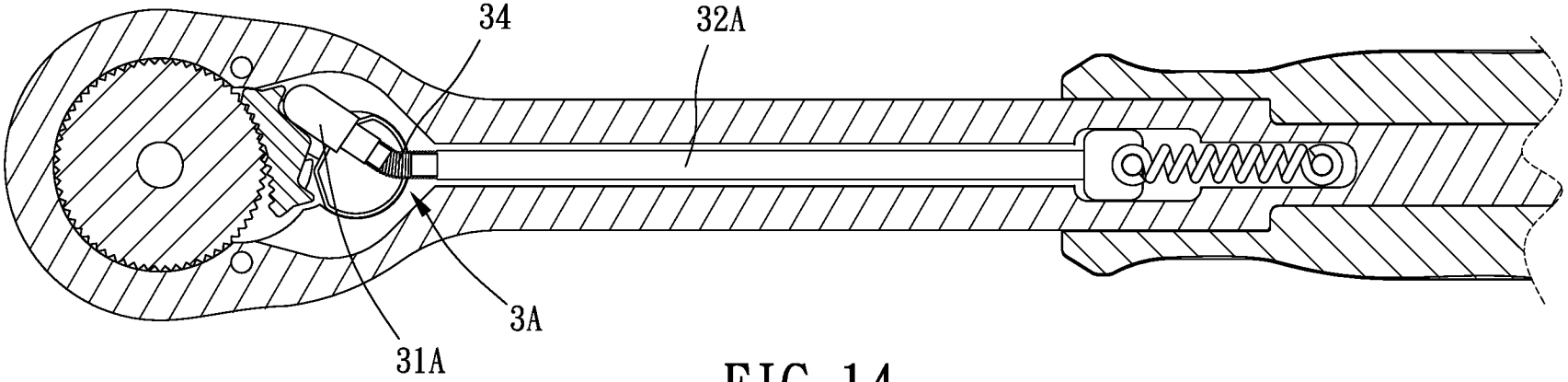
FIGS. 14 and 15 are drawings showing the switch mechanism of a second embodiment of the present invention in operation.
Figure 15:
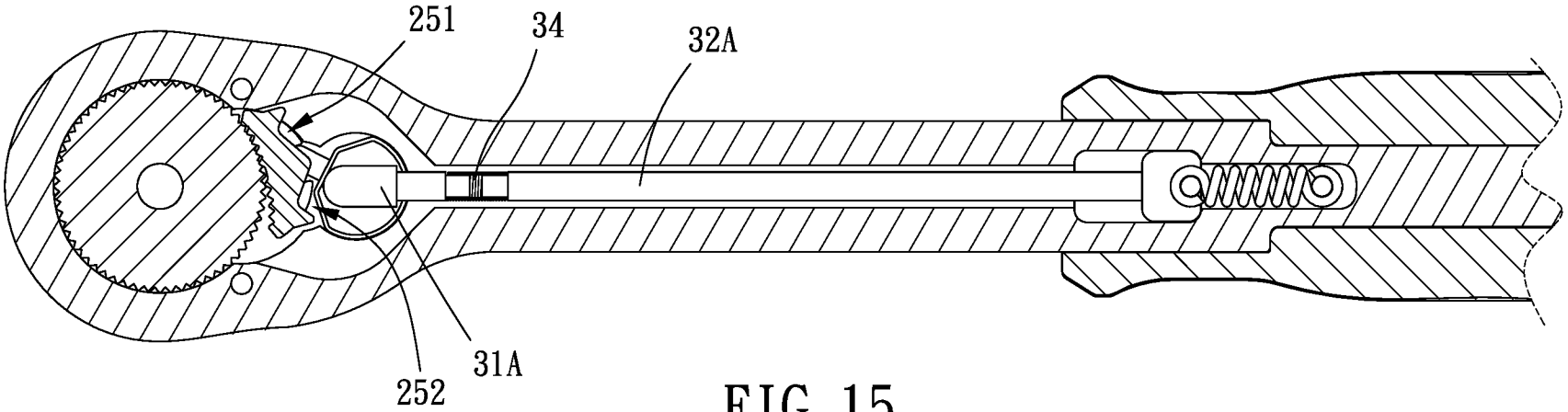

For example but not limited thereto, as shown in a second embodiment of FIGS. 14 and 15, the switch mechanism 3A further has a connection member 34 which is deformable, the connection member 34 is connected to and between the pushing member 31A and the moving member 32A, when the pushing member 31A is inserted into the first recess 251 or the second recess 252, the connection member 34 deforms accordingly, and the pushing member 31A swings relative to the moving member 32A.

Figure 16:
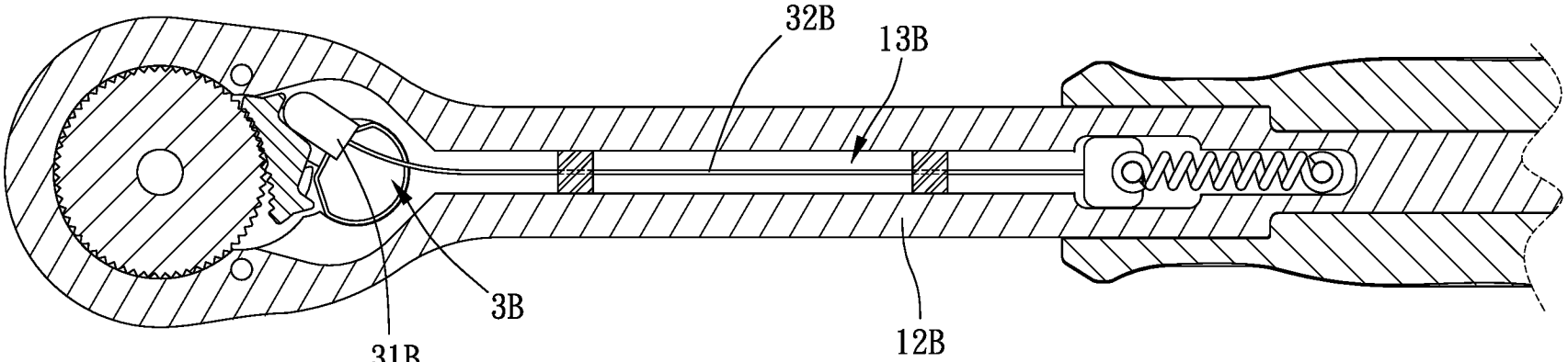
FIGS. 16 and 17 are drawings showing the switch mechanism of a third embodiment of the present invention in operation.
Figure 17:
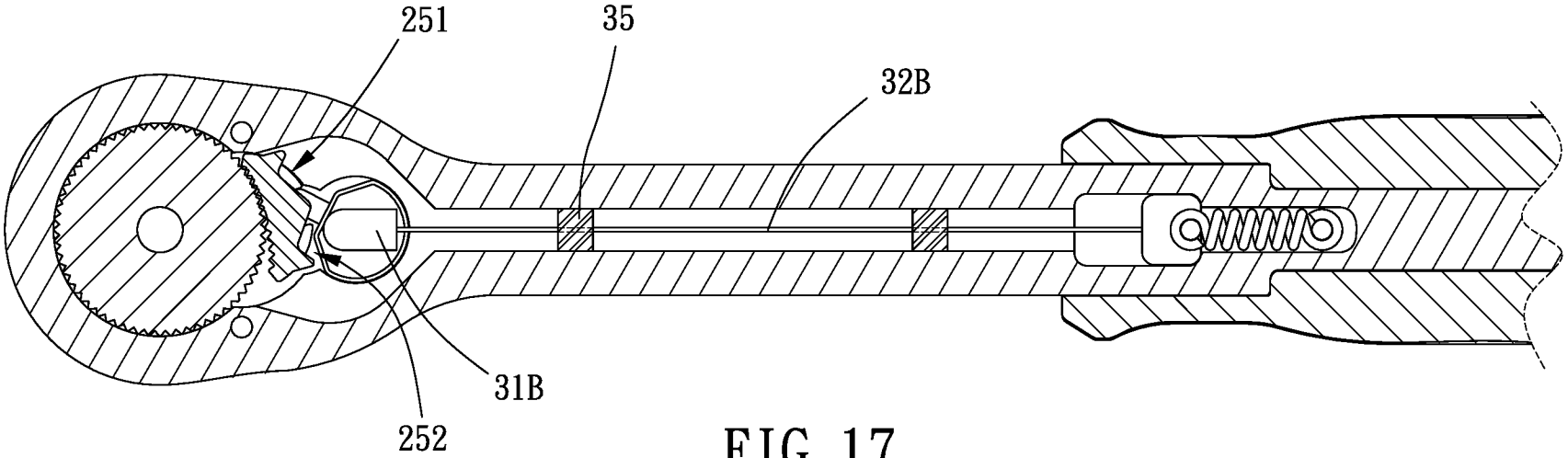

Or as shown in a third embodiment of FIGS. 16 and 17, the moving member 32B of the switch mechanism 3B is flexible, when the pushing member 31B is inserted into the first recess 251 or the second recess 252 and swings, a part of the moving member 32B swings with the pushing member 31B and deforms. The passage 13B of the handle portion 12B has at least one positioning member 35 for the moving member 32B to be disposed therethrough, and the at least one positioning member 35 abuts against the moving member 32B radially to ensure that a part of the moving member 32B within the handle portion 12B move linearly without deformation.

Given the above, with the ratchet wrench, when the user pushes the moving member toward the ratchet, the pushing member is inserted into a recess of the pawl unit and swings, and the pawl unit is meshed with a side of the ratchet. In addition, when the user wants to switch the rotation direction of the ratchet, the user only has to push the moving member again to make the pushing member inserted into another recess of the pawl unit. More importantly, when the head portion enters the narrow space, the handle portion is exposed beyond the space, so the user can control the control member on the handle portion directly to switch the rotation direction.

While we have shown and described various embodiments in accordance with the present invention, it should be clear to those skilled in the art that further embodiments may be made without departing from the scope of the present invention.

What is claimed is:

1. A ratchet wrench, including:

a main body;

a ratchet mechanism, including a ratchet and a pawl unit, the ratchet being rotatably received within the main body, the pawl unit being received within the main body and swingable relative to the ratchet, the pawl unit including a toothed portion, a first recess and a second recess, the toothed portion facing the ratchet, an opening of the first recess and an opening of the second recess being opposite to the ratchet;

a switch mechanism, including a pushing member and a moving member, the pushing member being disposed on the moving member and closer to the pawl unit, the moving member being disposed on the main body and movable toward the ratchet to drive the pushing member to insert into the first recess or the second recess;

wherein when the pushing member is inserted into the first recess, the pushing member pushes the pawl unit and swings toward a first direction to make a first end of the toothed portion meshed with the ratchet; when the pushing member is inserted into the second recess, the pushing member pushes the pawl unit and swings toward a second direction to make a second end of the toothed portion meshed with the ratchet, and the second direction is opposite to the first direction;

wherein the pawl unit has an insertion hole, the insertion hole and the first and second recesses are on two opposite end portions of a side of the pawl unit facing the moving member, the ratchet wrench further includes a support mechanism, the support mechanism includes a pivot member, an elastic member and an abut member, the pivot member is swingably positioned on the main body, the elastic member is received within the pivot member, one of two ends of the abut member abuts against the elastic member, the other of the two ends of the abut member is inserted into the insertion hole, and the pivot member and the pawl unit are in a co-rotation relationship.

2. The ratchet wrench of claim 1, wherein two halves of the pawl unit have symmetrical structures with respect to a center line of the pawl unit, the first and second recesses are spacingly arranged by two opposite sides of the center line, the first and second recesses have a protrusion therebetween, the insertion hole corresponds to the protrusion on a direction perpendicular to the center line, and the center line separates the protrusion and the insertion hole evenly.

3. The ratchet wrench of claim 2, wherein on a direction which is lateral to the moving direction of the moving member, the pushing member and the pivot member are stacked; the ratchet wrench further includes a rebound member, one of two ends of the rebound member is arranged on the main body, the other of the two ends of the rebound member is arranged on the switch mechanism, and the moving member has a tendency to move away from the ratchet normally; when the first end of the toothed portion is meshed with the ratchet, the second recess is on an extension direction of the moving member; when the second end of the toothed portion is meshed with the ratchet, the first recess is on the extension direction of the moving member; the main body includes a head portion and a handle portion which communicate with each other, the ratchet mechanism is received within the head portion, the moving member is received within the handle portion, and at least one part of the pushing member projects into the head portion; the handle portion has a passage, the passage communicates with an interior of the head portion, and the moving member is movably disposed through the passage; when the moving member moves away from the ratchet, a pivoting point of the pushing member and the moving member enters the passage, and at least one wall which defines the passage is configured to guide and restrict the pushing member to be in line with the moving member; when the moving member moves toward the ratchet, the pivoting point of the pushing member and the moving member moves out of the passage, and the pushing member is swingable relative to the moving member freely; a side of the at least one wall which is close to the pawl unit has a chamfered portion which is curved, and when the moving member moves away from the ratchet, the pushing member which is tilted is pushed by the chamfered portion to gradually swing to be in line with the moving member; as viewed in a direction which is perpendicular to the moving direction of the moving member, the insertion hole is C-shaped, a contour of the protrusion is upside-down V-shaped, and a contour of a circumferential wall of the first recess, a circumferential wall of the second recess and the protrusion is W-shaped; the circumferential wall of the first recess includes a tilted wall and a block wall which are laterally connected to each other, the tilted wall extends toward a direction which is close to the ratchet but away from the center line, the pushing member swings along the tilted wall to abut against the block wall to be in a co-swinging relationship, a circumferential wall structure of the second recess is the same as a circumferential wall structure of the first recess, and the circumferential wall structure of the second recess and the circumferential wall structure of the first recess are symmetrically arranged with the center line as the symmetry axis; the switch mechanism further includes a control member, the control member is positioned on an end of the moving member remote from the ratchet and projects beyond the main body, and the control member and the moving member are in a co-movement relationship; an area of a cross-section of the control member is twice an area of a cross-section of the moving member or more; the ratchet wrench further includes a grip, and a part of the main body is inserted into the grip; the moving member and the pushing member are each elongated; a ratio of a length of the moving member and a length of the pushing member is greater than 3; the passage is defined by two walls, the two walls are spacingly arranged by two opposite sides of the grip, and the two walls are each elongated.

4. The ratchet wrench of claim 1, wherein when the first end of the toothed portion is meshed with the ratchet, the second recess is on an extension direction of the moving member; when the second end of the toothed portion is meshed with the ratchet, the first recess is on the extension direction of the moving member.

5. The ratchet wrench of claim 1, wherein the switch mechanism further has a connection member which is deformable, the connection member is connected to and between the pushing member and the moving member, when the pushing member is inserted into the first recess or the second recess, the connection member deforms accordingly, and the pushing member swings relative to the moving member.

6. The ratchet wrench of claim 1, wherein the moving member of the switch mechanism is flexible, when the pushing member is inserted into the first recess or the second recess and swings, a part of the moving member swings with the pushing member and deforms.

7. A ratchet wrench, including:

a main body;

a ratchet mechanism, including a ratchet and a pawl unit, the ratchet being rotatably received within the main body, the pawl unit being received within the main body and swingable relative to the ratchet, the pawl unit including a toothed portion, a first recess and a second recess, the toothed portion facing the ratchet, an opening of the first recess and an opening of the second recess being opposite to the ratchet;

a switch mechanism, including a pushing member and a moving member, the pushing member being disposed on the moving member and closer to the pawl unit, the moving member being disposed on the main body and movable toward the ratchet to drive the pushing member to insert into the first recess or the second recess;

wherein when the pushing member is inserted into the first recess, the pushing member pushes the pawl unit and swings toward a first direction to make a first end of the toothed portion meshed with the ratchet when the pushing member is inserted into the second recess, the pushing member pushes the pawl unit and swings toward a second direction to make a second end of the toothed portion meshed with the ratchet, and the second direction is opposite to the first direction;

wherein the pushing member is swingably pivoted to the moving member;

wherein the main body includes a head portion and a handle portion which communicate with each other, the ratchet mechanism is received within the head portion, the moving member is received within the handle portion, and at least one part of the pushing member projects into the head portion; the handle portion has a passage, the passage communicates with an interior of the head portion, and the moving member is movably disposed through the passage; when the moving member moves away from the ratchet, a pivoting point of the pushing member and the moving member enters the passage, and at least one wall which defines the passage is configured to guide and restrict the pushing member to be in line with the moving member; when the moving member moves toward the ratchet, the pivoting point of the pushing member and the moving member moves out of the passage, and the pushing member is swingable relative to the moving member freely.

8. The ratchet wrench of claim 7, wherein a side of the at least one wall which is close to the pawl unit has a chamfered portion which is curved, and when the moving member moves away from the ratchet, the pushing member which is tilted is pushed by the chamfered portion to gradually swing to be in line with the moving member.

* * * * *